United States Patent [19]

Smith et al.

[11] 4,094,760

[45] June 13, 1978

[54] METHOD AND APPARATUS FOR DIFFERENTIALLY AND SIMULTANEOUSLY ELECTROCOATING THE INTERIOR AND EXTERIOR OF A METAL CONTAINER

[75] Inventors: David A. Smith, Murrysville; John J. Davidson, New Kensington, both of Pa.

[73] Assignee: Aluminum Company of America, Pittsburgh, Pa.

[21] Appl. No.: 818,846

[22] Filed: Jul. 25, 1977

[51] Int. Cl.[2] ..... C25D 13/12

[52] U.S. Cl. ..... 204/181 R; 204/181 C; 204/300 EC

[58] Field of Search ..... 204/181 R, 181 C, 300 EC

[56] References Cited

U.S. PATENT DOCUMENTS 3,849,284 11/1974 Kossman ..... 204/181 R 3,922,213 11/1975 Smith et al. ..... 204/181 R

*Primary Examiner*—Howard S. Williams

*Attorney, Agent, or Firm*—Patrick J. Viccaro

[57] ABSTRACT

A method and apparatus provided for applying an electrocoat on the interior and exterior of a metal container simultaneously. The interior and exterior of a metal container may be either uniformly or differentially coated. An electrically conductive probe including a nozzle is inserted into a metal container and an electrically conductive housing is enclosed around the container to seal the container therein and to form a continuous passageway from the probe-nozzle to the outer housing. As flowing electrocoating material floods the container in a transient bath, an electrical potential is simultaneously impressed between the container and the probe-nozzle to electrocoat the interior of the container, and between the container and the outer housing to electrocoat the exterior of the container.

18 Claims, 6 Drawing Figures

METHOD AND APPARATUS FOR DIFFERENTIALLY AND SIMULTANEOUSLY ELECTROCOATING THE INTERIOR AND EXTERIOR OF A METAL CONTAINER

BACKGROUND OF THE INVENTION

This invention relates to electrocoating a container. More particularly, the invention relates to electrocoating the interior and exterior of a metal container simultaneously.

Usually, metal containers, such as cans and the like, have their interior surfaces and exterior surfaces coated in separate operations. The interior coating is usually applied at a thicker coating weight than the subsequently applied exterior coating. The thicker interior coating is required for protection of the container from its contents and protection of the contents of the container from reaction with the metal, while the thinner exterior coating may improve handling of the container and/or its aesthetic appearance. Additionally, an exterior coating can offer protection against the container environment, such as by inhibiting the rusting of steel and tin-free steel containers in moist atmospheres and the forming of excessive oxide on aluminum containers during retort.

The coating materials may be applied by sprays, rolls, immersion or the like, using conventional polymer systems, or by using electrocoating techniques. Electrocoating can provide uniform and consistent films and thus is a desirable approach. As used herein, electrocoating is the electrodeposition of resinous coating materials, preferably organic, on electrically conductive surface areas from either anodic or cathodic electrocoating material mediums. A layer of particulate coating material is electrodeposited on an electrically charged metal substrate immersed or surrounded in the coating material as an electric current flows between the substrate and an oppositely electrically charged electrode.

U.S. Pat. No. 3,476,667, issued Nov. 4, 1969, discloses a method and apparatus for electrodepositing a coating on the inside and outside of a hollow article. An article is placed in a bath of coating material in a tank, which is equipped with electrodes, such as cathodes. An auxiliary electrode is positioned within the article and insulated therefrom. The auxiliary electrode and the tank electrodes must be of the same charge. An electrical potential is imposed between the article and all the electrode assemblies resulting in a coating on the outside of the article and a coating on the inside of the article. While such method of electrocoating may produce desirable results, it is not suitable for high speed production lines, such as are typical in the can-making industry.

Another prior art patent shows the use of inside and outside electrodes for treating the surfaces of containers. U.S. Pat. No. 2,876,358, issued Mar. 3, 1959, discloses a method and apparatus for surface treating thermoplastic containers using an outside electrode which holds a container and an inner electrode insertable into the container. The adherence characteristics of surfaces of the thermoplastic container are to be improved by subjecting the surfaces to an electrical corona discharge in an air gap between the inner and outer electrodes.

U.S. Pat. No. 3,922,213, issued Nov. 25, 1975, to the common assignee of the present invention discloses a process and apparatus for uniformly electrocoating the interior of a shaped metal container. A shaped metal container is uniformly electrocoated in an inverted position by the insertion of an electrically conducting nozzle therein through which coating material may flow into the interior of the container at a flow rate sufficient to fill the container and maintain a transient bath. An electrical potential is impressed between the container and the nozzle to coat the interior of the container. When the nozzle is removed, the container empties without further mechanical operation.

The method and apparatus of that patent considerably improved the techniques for electrocoating metal containers in high speed production lines. Slower prior art processes are avoided. The present invention is an improvement over the method and apparatus of that patent for there exists the need to electrocoat both the interior and exterior of a metal container simultaneously in one high speed operation and yet be able to apply different coating weights on the interior and exterior surfaces.

SUMMARY OF THE INVENTION

In accordance with the present invention, a method and apparatus are provided for simultaneously electrocoating the interior and exterior of a metal container. The method and apparatus also provide for a coating weight differential between the interior and exterior surfaces of a container. A container is positioned with its open end down, an electrically conductive probe, including a nozzle, is inserted therein, and an outer electrically conductive housing encloses the container such that continuous passageways are formed leading from the nozzle of the probe to the interior of the container to the exterior of the container. Electrocoating material may be flowed through the nozzle into the container interior to fill the continuous passageways from the interior of the container to the exterior of the container creating a transient bath which floods the entire container in electrocoating material. The probe-nozzle and the outer housing are electrically charged of the same polarity. An electrical potential is simultaneously impressed between the container and the probe and between the container and the outer housing resulting in the interior and exterior of the container being electrocoated. Imposition of different electrical potentials results in differential coating of the interior and exterior of the container.

An object of the invention is to provide a method and apparatus for electrocoating the interior and exterior of the metal container simultaneously in one rapid operation which is suitable for high speed production. Another object of the invention is to facilitate electrocoating of a metal container with a uniform coating having a controlled coating weight.

A further object of the invention is to simultaneously and differentially electrocoat the interior and exterior of a metal container.

DETAILED DESCRIPTION OF THE PREFERRED EMBODIMENTS

Figure 1:
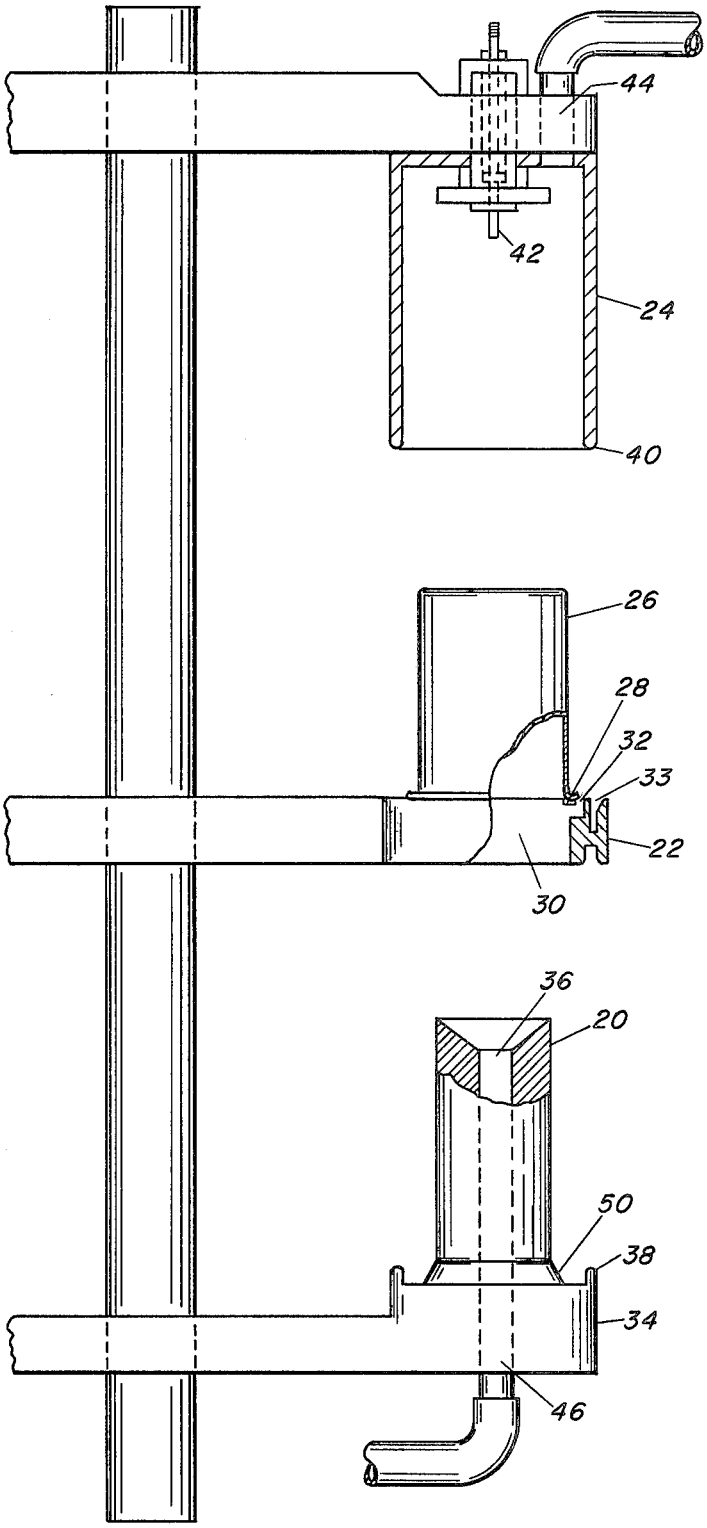
FIG. 1 is a partial, cross-sectional view of a preferred embodiment of an apparatus of the present invention.

FIG. 1 illustrates an embodiment of the apparatus of the present invention in a preferred arrangement. The apparatus includes a probe-nozzle 20, a container holder 22 and an outer housing 24 arranged in-line vertically with respect to one another with outer housing 24 above container holder 22 which is above probe-nozzle 20.

Can holder 22 is adapted to hold container 26 with its open end down in an inverted position. Container 26 need not be securely held to the can holder 22, but may rest in holder 22 in a container nest 28, preferably, having a groove or recess in its top surface substantially conforming to the perimeter of the open end of container 26. For containers, such as cans or the like, container nest 28 may be an annular ring, but for containers having other than a circular open end, the container nest 28 may take the shape of the container opening. Though container holder 22 is shown and described with a nesting arrangement for retaining container 26, other embodiments are within the scope of the present invention. For example, a partial ring of greater than 180° in circumference could be used to frictionally fit about the container to hold it in place. In all embodiments, however, the container nest 28 has a central opening 30 therethrough to permit the insertion of an electrical probe-nozzle 20 to permit electrocoating of the interior of the can. Container nest 28 may be made of electrically conductive materials or insulative materials for reasons yet to be described.

Container holder 22 includes passageways 32 which connect the central opening 30 from the interior of container 26 to the exterior of container 26 near and about the rim of container 26. Passageways 32 may be formed in container nest 28 as further illustrated in FIG. 2, or in a portion of container holder 22.

Figure 2:
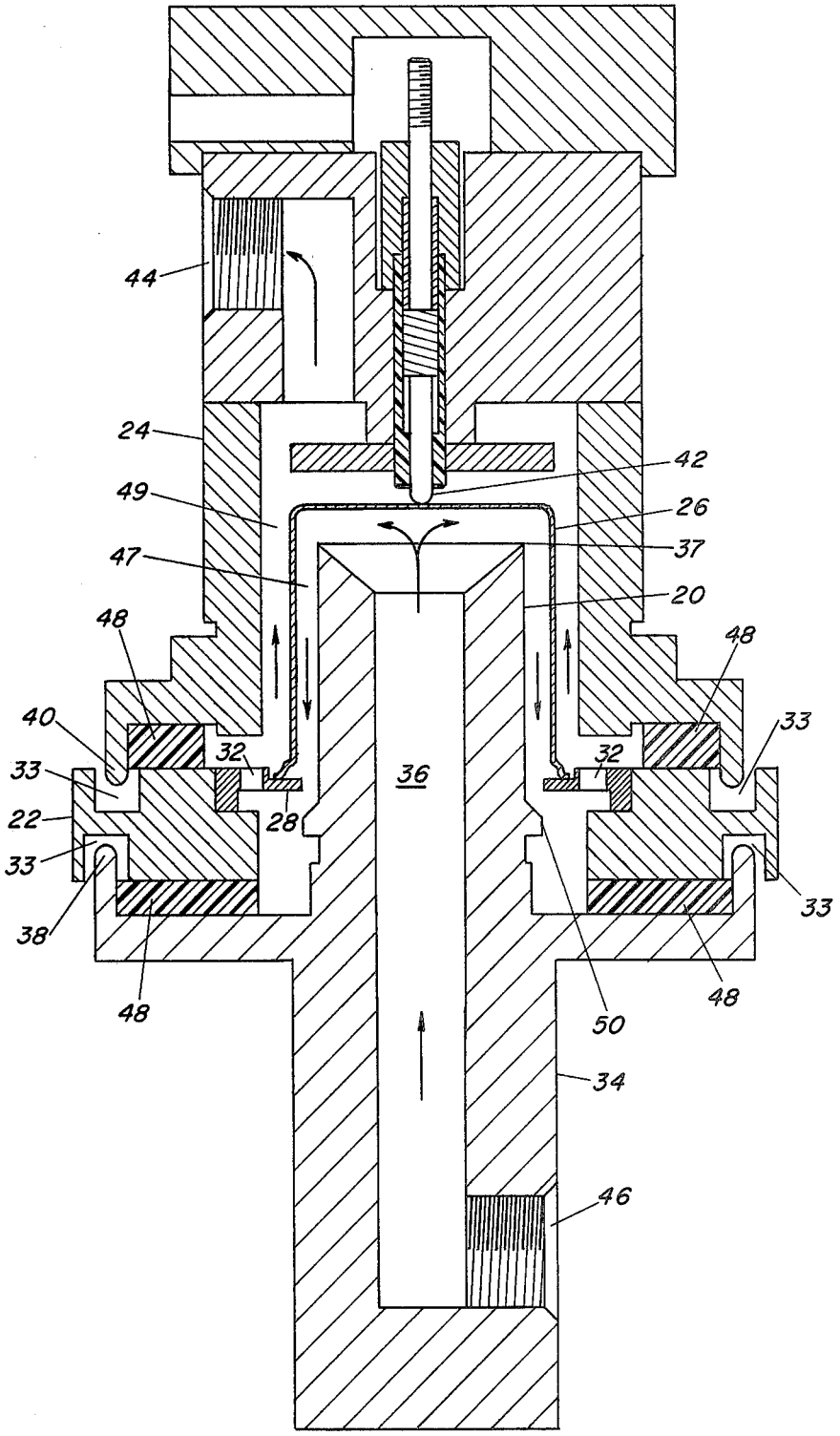
FIG. 2 is a detailed cross-sectional view of the apparatus of FIG. 1 during a condition of electrocoating.

Container holder 22 also includes means on the upper and lower surfaces for detachably receiving, respectively, portions of outer housing 24 and base portion 34 of probe-nozzle 20. Such means for connection may be in the form of a groove 33 radially outward from the rim of container 26 as shown in FIGS. 1 and 2. The upper and lower annular grooves 33 can provide a liquid-tight means for sealingly enclosing container 26 as further shown and described in FIG. 2.

Probe-nozzle 20 projects upwardly from a base portion 34. Probe 20 is hollow and may itself be a nozzle, or may include nozzle portions for flowing electrocoating material into the interior of a container to be coated. Alternately, hollow probe 20 may include an orifice and orifice portions for flowing electrocoating material out from the interior of a coated container. Preferably, probe 20 is a nozzle, as shown in FIG. 1, having a nozzle bore 36 extending longitudinally therethrough and terminating in base 34 as port 46. Preferably, port 46 is an inlet port which is connected to a conduit for providing electrocoating material from a source or reservoir supply. A nozzle bore 36 may be wider at its uppermost portions forming a narrow edge 37 and may have a generally conical or concave opening at its upper portion to aid the flow of electrocoating material into the interior of container 26. Such a wider opening also provides for an improved electrocoating on the interior of the can near the container bottom when an electrical potential is impressed between the nozzle and container. Narrow edge 37 improves flow patterns of electrocoating material into the container interior as well as increasing the throwing power of the bath to coat any deep recesses of the container interior surface.

Base portion 34 of probe-nozzle 20 may have upward annular projections 38 for detachably engaging and sealing with groove 34 of container holder 22. Probe-nozzle 20 must be electrically conductive and, preferably, generally conforms in shape to the interior of a container and is made of anti-corrosive or non-corrosive materials. As used herein, the shape of various parts of the apparatus of the present invention "generally conforms" to the container shape when the geometric shape, such as cylindrical or cubical, coincide though the detailed configuration including grooves, ridges and the like may not be present.

Outer housing or shell 24 is electrically conductive and generally conforms to the exterior shape of the container to be electrocoated. Housing 24 is larger than the container and, preferably, is also anti-corrosive. Lower edge 40 of housing 24 is detachably engageable with upper groove 33 of container holder 22. On the interior upper wall of housing 24 is a spring contact 42 which may be centrally located such that when housing 24 encloses container 26, contact 42 is caused to retract as it contacts the bottom wall of container 26. One purpose of contact 42 in housing 24 is to retain the container 26 in a fixed position on container nest 28 during the electrocoating cycle. Near or in the upper wall of housing 24 is port 44, preferably, an exhaust port which permits electrocoating material to flow out of housing 24 during the electrocoating cycle only after it has flowed along nearly the whole exterior container surface. In that way enough electrocoating material may be flowed into the enclosure to completely fill the interior of container 26 and housing 24 so as to completely immerse or flood container 26 to be electrocoated. The electrocoating bath remains transient, however, in that there is a constant flow of electrocoating material. The electrocoating material may be supplied through inlet ports 46, illustrated in FIG. 1, being connected to nozzle bore 36 of probe-nozzle 20. Alternatively, a supply of electrocoating material may flow through port 44 to coat a container and be exhausted from a container interior through bore 36.

FIG. 2 illustrates a more detailed version of the apparatus of FIG. 1 in cross-section as it is in condition to commence electrocoating. Housing 24, container holder 22 and base portion 34 are displaced vertically with respect to one another to a closed condition. Such vertical displacement can be actuated by pneumatic cylinders, cams or other conventional means, not shown.

Lower edge 40 of housing 24 is in place in annular groove 33 on the upper surface of container holder 34. Similarly, projection members 38 of base portion 34 are in annular groove 33 on the lower surface of container holder 34. Container 26 is retained in position in container nest 28, such that the rim of the open end of inverted container 26 rests in container nest 28. Spring contact 42 of housing 24 is shown adjacent the bottom wall of container 26 in a retracted position so the spring is activated and exerts a downward force to retain container 26 on container nest 28.

Container nest 28 also includes passageways 32 which connect space 47 with space 49. Space 47 exists between the probe-nozzle 20 and the interior surfaces of container 26. A continuous passageway is formed from nozzle bore 36 to space 47 and through passageway 32 to space 49 between the outer surface of container 26 and the inner surface of housing 24 before it exits through exhaust port 44. The arrangement shown in FIG. 2 permits a flow of electrocoating material from inlet port 46 to exhaust port 44 during the electrocoating cycle while allowing the continuous passageway (36, 47, 32, and 49) to be filled with electrocoating material to subject the container 26 to a total immersion and flooding in electrocoating material.

Between the upper surface of container holder 22 and a lower edge of housing 24 is shown a sealing means 48 which may also be provided between the lower surface of container holder 22 and base portion 34. Sealing means 48 provides a detachable, liquid-tight seal between housing 24, container holder 22 and base portion 34 for retaining therein the electrocoating material which provides a transient bath during the electrocoating cycle.

Figure 3:
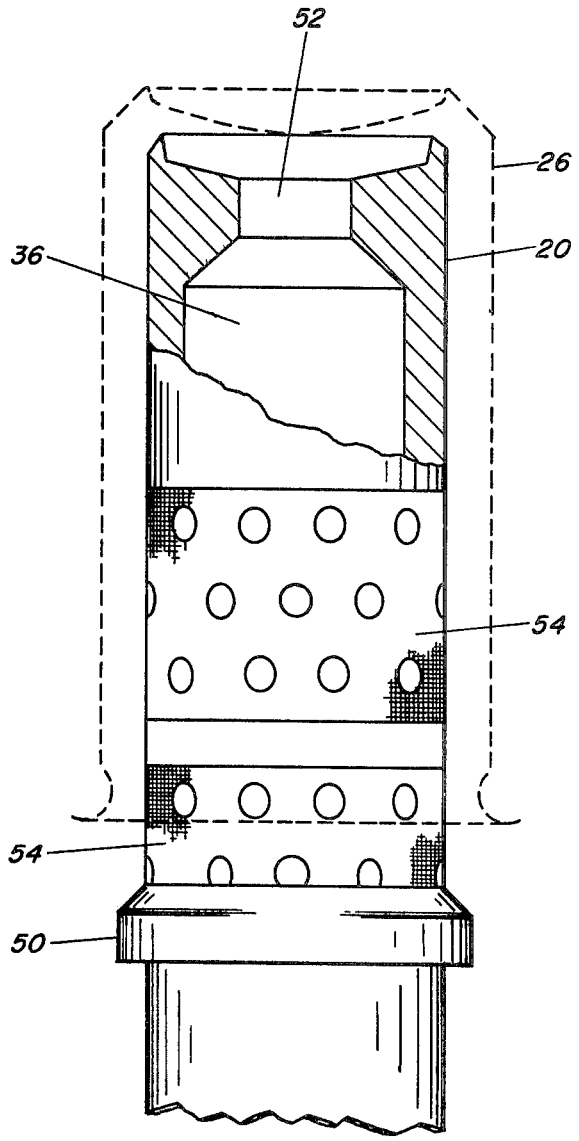
FIG. 3 is a partial cross-sectional view of a preferred embodiment of a probe-nozzle of the present invention.

FIG. 3 illustrates a partial cross-sectional view of a preferred embodiment of probe-nozzle 20 of the present invention, including a restricter 50 on the lower portion thereof which is of a diameter greater than the diameter of probe-nozzle 20. When probe-nozzle 20 is inserted to its fullest extent needed into container 26, restricter 50 is located at or below the area of the probe 20 adjacent the rim of the open end of inverted container 26 (shown in dotted lines). The purpose of restricter 50 is to maintain or reduce the area between probe-nozzle 20 and the interior surface of container 26 near the rim in order to restrict the flow of electrocoating material in the preferred embodiment from space 47 in the interior of container 26. Restricting the flow aids in maintaining a full transient bath in container 26 to permit improved electrocoating.

Nozzle bore 36 may be of various configurations, but it is preferred that the bore have an increasing diameter at the upper end of probe-nozzle 20 near the inside surface and bottom wall of container 26. As described with reference to FIG. 1, such opening 52 may be conical, concave or having generally diverging walls. The purpose of a wider opening 52 is for better directional control of the flowing electrocoating material and to improve the throwing power of the bath to coat recesses of the container interior.

In a preferred embodiment, it has been found that the uniformity of the electrocoating on the interior of the container 26 can be improved by preselecting the conductivity of various external surface areas of the probe-nozzle 20 by the use of insulating means 54. A less complex manner of doing so is illustrated in FIG. 3 where a reduction in conductivity is provided for by the addition of insulating tape on the surface of the probe-nozzle 20. Such tape may be added in any number of a variety of ways and may be solid, as shown on the lower portion of probe-nozzle 20, or it may contain perforated holes or openings, as shown in the central portion of probe-nozzle 20. By trial and error, the appropriate insulating characteristics can be determined for a particularly shaped metal container 26.

It has been found that an almost identical relationship between the container interior and nozzle configuration permits better flow of electrocoating material to all surfaces of the container interior and permits faster electrocoating. A probe-nozzle of almost identical relation to a container is one that conforms in most detail to the interior surfaces of a container with approximately equal spacing between each point on exterior surfaces of the probe-nozzle and a corresponding point on the interior surfaces of the container.

Figure 4:
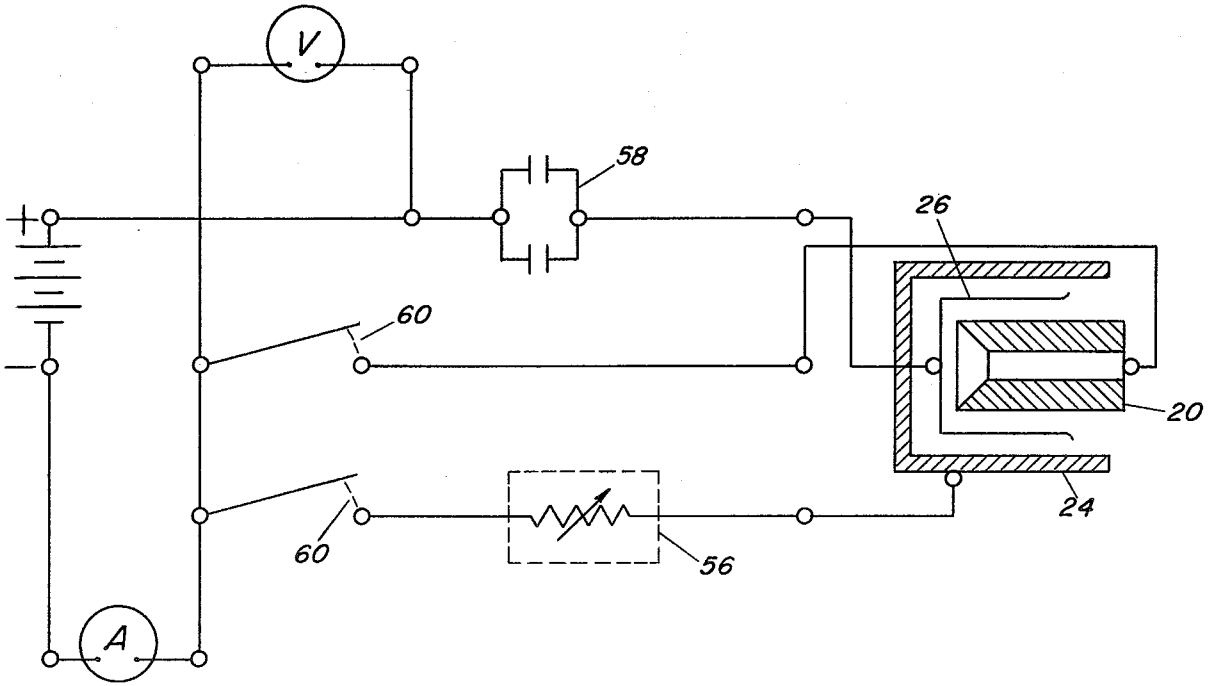
FIG. 4 is a schematic diagram of an electrical circuit of the present invention.

FIG. 4 illustrates a schematic diagram of an electrical circuit of the present invention. A source of direct current (DC) has one terminal thereof connected to the container 26 to be electrocoated, and the other terminal connected to both the internal or inner electrode (probe-nozzle 20), and an external or outer electrode (outer housing 24). More than one source of direct current may be used to impress the appropriate electrical potentials between the elements of the electrocoating apparatus, but only a single source is illustrated in FIG. 4. The internal and external electrodes must be of the same polarity, whether of positive or negative charge, i.e. cathode or anode, in order to electrocoat the container as contemplated by the present invention.

FIG. 4 further illustrates a manner of supplying a different electrical potential between inner electrode 20 and container 26 than between outer electrode 24 and container 26 by providing resistance in one branch of the circuit to act as a voltage divider. Preferably, resistance is provided for in the circuit between the direct current source and the outer electrode 24. Resistance may be in the form of a resistor bank or variable resistors, such as the rheostat type. Preferably, a variable resistor 56 is used for regulating the electrical current. The addition of resistance in a circuit branch for a constant voltage from the source results in a lower current passing through that portion of the circuit, which ultimately results in fewer coulombs and thus a lighter coating weight on the external surfaces of container 26. The end product, electrocoated container 26, will have a thicker coating on the interior of the container than the exterior of the container. The thicker coating is normally desired in the industry to protect the container from the contents of the container and to protect the contents from reaction with the container.

The electrical circuit also includes an ammeter and a voltmeter for measuring the amperage and voltage passing through the circuit in order that an operator of the apparatus can effectively control the coating weight on both the interior and exterior of the container 26. A portion of the circuit leading to the container electrode includes a DC breaker 58 for programming the voltage cycle duration which controls the amount of coating weights applied. Though FIG. 4 illustrates the container connected to the positive terminal of the direct current source, the polarity may be reversed depending upon whether the electrocoating material is anodic or cathodic. It is important, however, that the internal and external electrodes be the same polarity. The direct current power supply must be sufficient to supply amperage for simultaneously coating the inside and outside of the container. When operating in the preferred embodiment of differentially and simultaneously coating the interior and exterior of a container, the power supply must be able to handle the various voltages involved.

Figure 5:
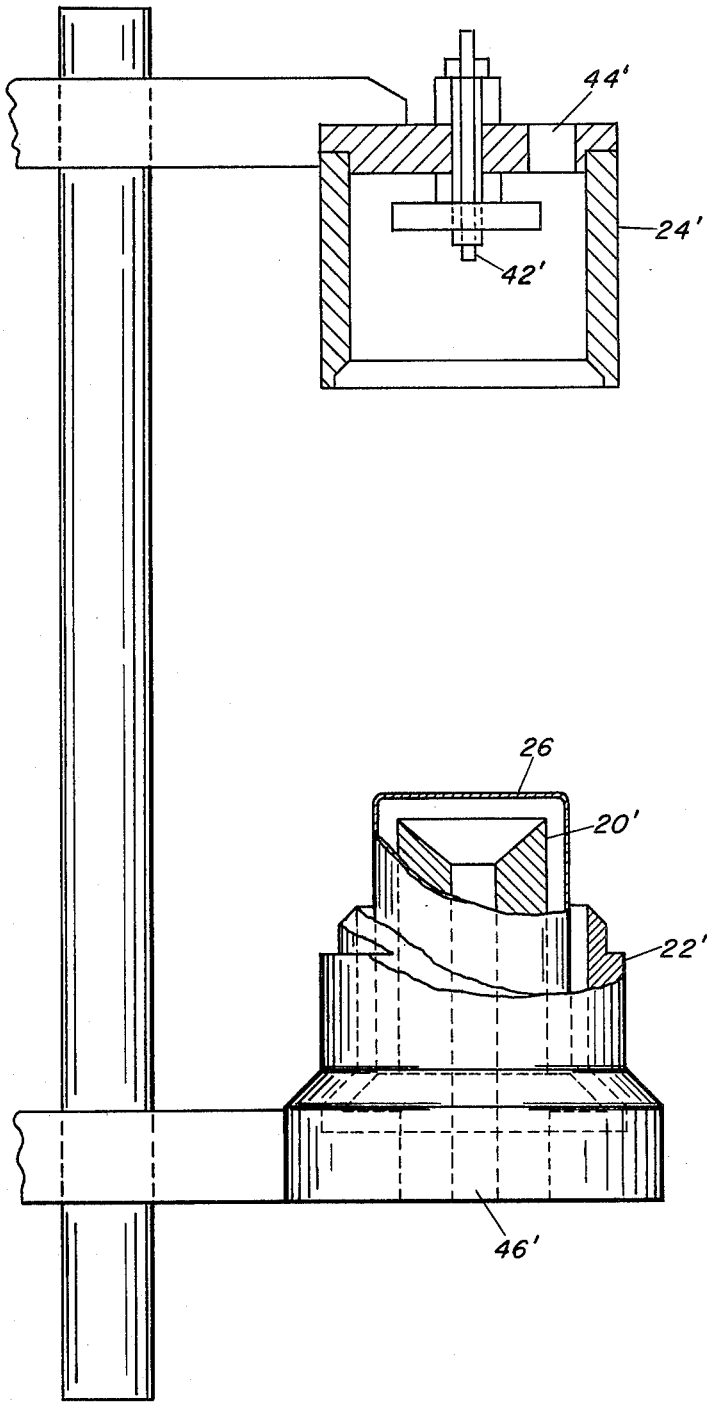
FIGS. 5 and 6 illustrate alternative embodiments of the apparatus of the present invention.

FIG. 5 illustrates a partial cross-sectional view of an alternative embodiment of the apparatus of the present invention. The coating apparatus illustrated includes an outer housing 24′ having therein a spring contact 42′ centrally located on the upper wall thereof. Container holder 22′ combines the features of the container holder 22 and probe-nozzle 20 shown in FIG. 1. Container holder 22′ retains the container in an inverted position and also acts as a semi-outside electrode for electrocoating the exterior of the container and as an inside electrode for coating the interior of the container. Probe-nozzle 20', the inside electrode, is attached integrally with container holder 22' with there being only two major elements of the apparatus which are moved vertically relative to one another. When in a closed position, the lower edges of outer housing 24' engage with portions of container holder 22' to completely enclose container 26 mechanically such that flowing electrocoating material can enter through inlet port 46' and exit the enclosure through exhaust ports 44'. Likewise, electrocoating material may enter through ports 44' and exit through 46'. The mechanical engagement of outer housing 24' and container holder 22' is also an electrical connection such that the engaged members act together as the outside electrode for electrocoating the exterior of container 26.

Figure 6:
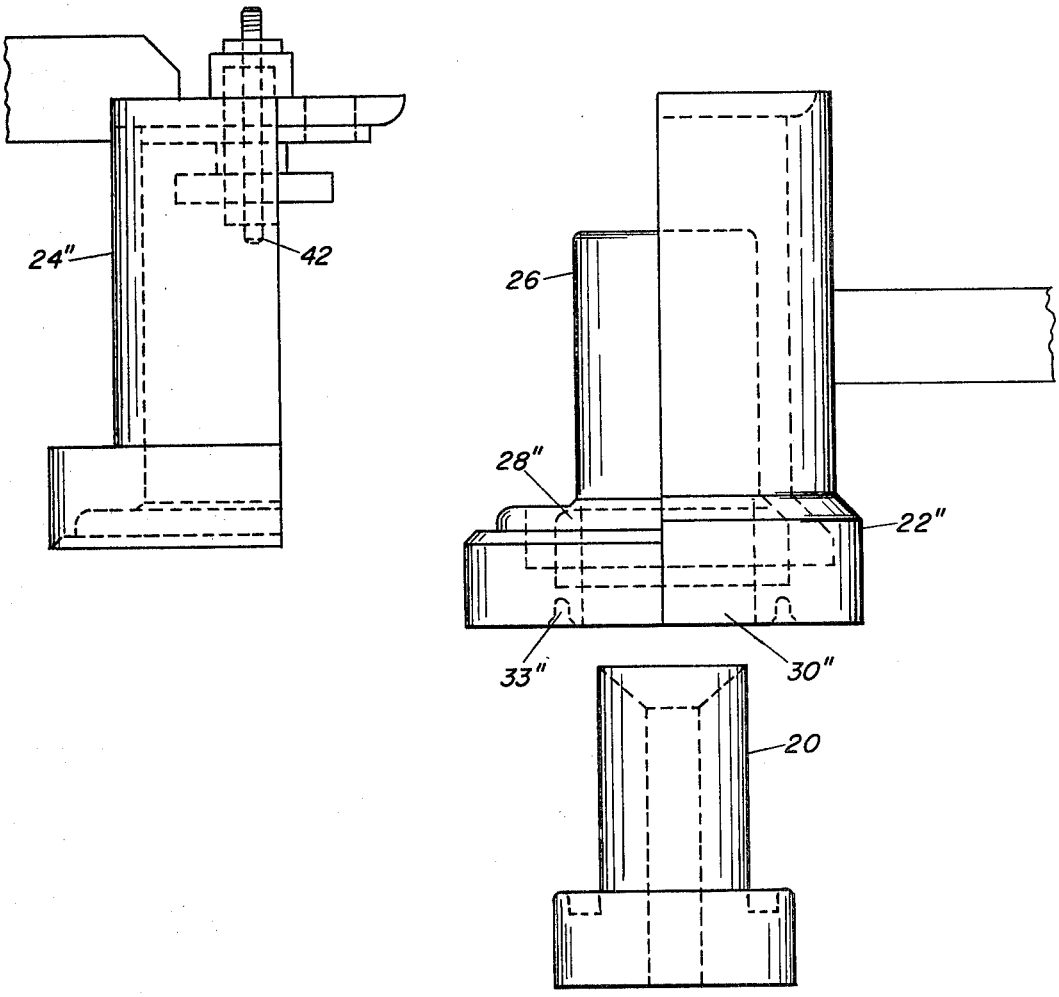

FIG. 6 illustrates a partial cross-sectional view of another alternative embodiment of an apparatus of the present invention. The apparatus illustrated in FIG. 6 requires either vertical relative movement, or horizontal relative movement between the elements of the apparatus to enclose a container therein. A container holder 22'' includes a container nest portion 28'' and a portion of an outer housing 24'' which acts as an outside electrode. The container holder 22'' mates with another portion of outer housing 24'' having spring contact 42 which retains container 26 in an inverted position which is enclosed therein. Probe-nozzle 20 is insertable through a central opening 30'' in the container nest 28'' into the inverted container 26 and is sealed against the lower surfaces of container holder 22'' such as grooves 33''. Container 26 is enclosed therein to permit electrocoating material to flow in through inlet ports and out through exhaust ports.

The use and operation of the apparatus of the present invention can be understood by reference to FIG. 1. With outer housing 24, container holder 22 and the probe-nozzle 20 in a separated condition as shown, a container 26 is placed in an inverted position on container holder 22. Container 26 rests in container nest 28 such that central opening 30 is in line with the open end of the inverted container. The outer housing 24 and probe-nozzle 20 are closed vertically relative to container holder 22 to completely enclose container 26, as shown in FIG. 2.

Container 26 may be placed in an inverted position on container holder 22 in any of a variety of convenient manners. As it is desirable to adapt the apparatus of the present invention to high speed production can coating lines, the can may be brought into position by mechanical arms or a rotary table or the like.

In a preferred manner of operation, once the apparatus is in the closed condition, the flow of electrocoating material is commenced through nozzle bore 36 until the electrocoating material has filled space 47 in the interior of the container 26, and most, if not all, the space 49 between container 26 and the inner surface of outer housing 24, before an electric potential is impressed. Tests have shown that to perform the method in the manner described, the electrocoating material may commence flowing about one-half second prior to impressing the electrical potential. The electrical potential is then impressed for a period of about one-half second. These times are nominal figures, and actual length of time for the operation of electrocoating a particular container depends on several variables. For complex container geometries, flowing of electrocoating material uniformly along the interior of the container is difficult, but the use of probe-nozzles having a generally conforming configuration improves the resulting coating of the container. After the container has been coated, the apparatus is opened such that housing 24, holder 22 and probe-nozzle 20 separate. Separation of these elements facilitates emptying the container and apparatus of coating material.

In addition to the use of conforming or nonconforming nozzle configurations, the flow rate and pressure of the in-flowing electrocoating material are important parameters with the flow rate of more importance than the pressure. A controllable flow rate prevents turbulence, bubbles, etc. on the interior of the container and allows electrocoating material to contact each point on the interior surface of the container. A pressure that is too high, however, results in an increasing velocity of the electrocoating material and in the formation of bubbles, turbulence or the like, which is undesirable. Thus, while it can been seen that a probe-nozzle 20 having at least a generally conforming configuration is an advantage to electrocoating the interior of a container, it is not necessary to the function of the present invention. The method of the present invention has resulted in satisfactory coating weights when the pressure at the nozzle entry of in-flowing electrocoating material ranges from 4 to 6 psi and is approximately 5 psi, and the flow rate is approximately 500 to 600 ml/sec. Assuming a constant coating time, constant voltage and a constant voltage on-time, the coating weights on the can have been observed to increase as the flow rate of the electrocoating material increases.

In order to increase the production speed, it is necessary to increase the voltage used during the electrocoating cycle in order to shorten the time needed to electrocoat the interior and exterior of each container. A voltage which is too high, however, may result in a rupture of the container itself or blistering of the electrocoating depending upon variables, such as the particular coating material and type of electrical contact with the container to be coated. It has been found that the present invention satisfactorily electrocoats containers within a wide voltage range of direct current. Though a range of 120 to 300 volts is preferred, lower voltages, such as 50 volts, have been found to be satisfactory, and it is believed that higher voltages can also work. In addition to voltage, amperage is controlled to maintain specific coating deposition weights. As with the voltage, a wide range of amperage has been found to work satisfactorily, though a practical range may be 6 to 16 amperes. The amperage is an important parameter to monitor for electrocoating material is rated by its coulomb efficiency, where one coulomb equals one ampere per second.

During the preferred electrocoating cycle, the outer housing 24, container 26 and probe-nozzle 20 are all electrically charged, but are insulated from one another such that it is the electrocoating material which acts as a conducting medium which commences electrodeposition on the container. If each element is not properly insulated, a short circuit would occur between container 26, probe-nozzle 20 and other housing 24 resulting in improper coating. Additionally, probe-nozzle 20 and outer housing 24 must be insulated from one another for the purpose of applying differential coating weights on the internal and external surfaces.

The container may be electrically charged by spring contact 42 or container nest 28. If spring contact 42 is the electrical contact, then container nest 28 is made of an insulating or non-conductive material. Tests have shown, however, that at higher voltages, spring contact 42, which makes a point contact with the bottom wall of container 26, may result in either a rupture of the electrocoated material or even result in a perforation of the container wall. Preferably, the spring contact for retaining the container 26 is insulated from the outer housing 24 and is made of insulative or non-conductive material and container nest 28 is made of conductive material insulated from container holder 22 in order to provide the electrical potential. In the preferred embodiment, higher voltages may be used thus eliminating the potential perforation problem associated with spring contact 42.

The electrocoating material applicable to the method of the present invention, preferably, should be an electrophoretic coating having a relatively high coulomb efficiency of at least 10 mg/coulomb. It must be able to adhere to aluminum and other metals and must be a waterbased or aqueous coating. Additionally, it is desirable that the coating be stable and be able to withstand the fluid flow pressures and air exposure to which it is subjected during the method of the present invention. During the coating cycle, the temperature of the bath of electrocoating material may range from 50 to 160° F (10° to 71° C) with a preferred range of from 85° to 110° F (29 to 43° C).

It appears that even after the source of the voltage, such as a rectifier, has been shut off, electrical current continues to flow resulting in additional electrocoating material being deposited on the container surfaces. The phenomenon may be referred to as "the capacitor effect". Through trial and error, it is possible to control the capacitor effect and allow it to deposit a calculated additional electrocoating material on the container by reducing the voltage potential to zero while the coating material continues to flow. Through the preferred method includes starting the flow cycle before the voltage cycle and stopping both cycles simultaneously, other combinations of steps also work. Thus the flow cycle and voltage cycle can be started and stopped either simultaneously, or before, or after the other.

As it is the object of the present invention, a method and apparatus are provided for differentially and simultaneously electrocoating an interior and exterior of the container, which is suitable for high speed production can lines. The apparatus coats containers at a rate of about 30 cans per minute wich results in a total time per can of less than about 2 seconds. The mechanical steps of closing the apparatus and opening the apparatus for insertion of another container in an inverted position may include an elapsed time of 1.4 seconds. During the time the apparatus is closed, the voltage and flow cycle times are each about ½ second in duration and, preferably, the flow cycle is 0.7 second in duration commencing about 0.2 second sooner than the voltage cycle.

Cans coated by the method and apparatus of the present invention exhibit coatings with very low and usually zero enamel ratings which essentially measures the electrical conductivity through the coating. Coatings on the container surfaces can be deposited at coating weights that may include a range of 0 to 12 milligrams/sq. inch, depending on many variables described herein, such as voltage, amperages, electrocoating material and the like.

Although a preferred embodiment and alternative embodiments have been illustrated and described, it will be apparent to those skilled in the art that many changes can be made therein without departing from the scope of the invention.

Having thus described the invention, what is claimed is:

1. A method of simultaneously electrocoating the interior and exterior of a metal container, which comprises:
   - inserting a hollow electrically conductive probe into a container;
   - enclosing the container within an outer electrically conductive housing generally conforming to the container exterior shape;
   - sealing said outer housing with said probe to form a continuous passageway from said hollow probe to the interior of the container to the exterior of the container between the container and said outer housing;
   - flowing electrocoating material through said probe, said outer housing and said continuous passageway therebetween to flood the container in a transient bath of electrocoating material;
   - impressing an electrical potential between the container and said probe to electrocoat the interior of the container and simultaneously therewith impressing an electrical potential between the container and said outer housing to electrocoat the exterior of the container, said probe and said outer housing having the same electrical polarity.

2. The method as set forth in claim 1 wherein the configuration of said probe is in general conformity with the container interior.

3. The method as set forth in claim 1 in which the container is inverted with its open end in a downwardly direction.

4. The method as set forth in claim 1 in which said outer housing is electrically insulated from said probe and further including impressing different electrical potentials simultaneously to differentially electrocoat the interior and exterior of the container.

5. The method as set forth in claim 1 further providing the exterior surfaces of said probe with preselected conductivity for controlling deposition of the electrocoating material on the container interior.

6. The method as set forth in claim 1 in which flowing electrocoating material enters through said probe into said continuous passageway and exits through said outer housing.

7. The method as set forth in claim 6 wherein flowing of the electrocoating material commences prior to impressing the electrical potentials and ceases after discontinuing the impressions of the electrical potentials.

8. A method of simultaneously electrocoating the interior and exterior of a metal container comprising:
   - inserting a hollow inner electrode into a container with the electrode generally conforming to the interior of the container but spaced from the surface thereof;
   - enclosing the container with an outer electrode spaced from the exterior surface of the container;
   - sealing said outer electrode with said inner electrode;
   - flowing electrocoating material through said outer and inner electrodes to flood the interior and exterior surfaces of the container with such material; and while flooding the container surfaces,
   - applying an electrical potential across said inner electrode and the container and across said outer electrode and the container to electrocoat both the interior and exterior surfaces of the container.

9. A method as set forth in claim 8 in which the container is positioned with its open end down.

10. A method as set forth in claim 8 which further includes electrically insulating said outer electrode from said inner electrode for applying different electrical potentials to differentially electrocoat the interior and exterior surfaces of the container.

11. An apparatus for simultaneously electrocoating the interior and exterior of a metal container comprising:

a hollow electrically conductive probe generally conforming to the container interior shape and insertable into the interior of the container;

means for enclosing the container, said enclosing means being electrically conductive;

means for sealing the container between said probe and said enclosing means to form a continuous passageway therebetween to permit electrocoating material to fill the passageway to flood the container in a flowing bath of electrocoating material;

means for impressing an electrical potential between the container and said probe and simultaneously impressing an electrical potential between the container and said enclosing means, said probe and enclosing means being of the same polarity.

12. The apparatus as set forth in claim 11 further including a means for retaining the container in an inverted position.

13. The apparatus as set forth in claim 11 wherein said means for impressing the electrical potentials includes the capacity to impress different electrical potentials simultaneously to differentially electrocoat the interior and exterior of the containers and wherein said probe is electrically insulated from said enclosing means.

14. The apparatus as set forth in claim 11 wherein the external surfaces of said probe have preselected conductivity for controlling the deposition of the electrocoating on the container interior.

15. The apparatus as set forth in claim 11 wherein means are provided for commencing flow of electrocoating material prior to impressing the electrical potentials and ceasing flow after discontinuing the impressions of the electrical potentials.

16. The apparatus as set forth in claim 11 wherein an electrode contacts the container at the container flange to electrically charge the container.

17. The apparatus as set forth in claim 11 wherein an electrode contacts the container at the exterior of the bottom wall of the container to electrically charge the container.

18. The apparatus as set forth in claim 11 further having a means for restricting the flow of electrocoating from the inverted container, said means carried by said probe.

* * * * *